United States Patent [19]

Canosa

[11] Patent Number: 4,638,826

[45] Date of Patent: Jan. 27, 1987

[54] DISHWASHING APPARATUS

[76] Inventor: Joseph F. Canosa, 5701 Blvd. E, Apt. 3A, West New York, N.J. 07093

[21] Appl. No.: 749,106

[22] Filed: Jun. 26, 1985

[51] Int. Cl.[4] ..... B08B 3/02

[52] U.S. Cl. ..... 134/100; 134/115 R; 134/177

[58] Field of Search ..... 134/59, 93, 99, 100, 134/115 R, 172, 177, 200, 201

[56] References Cited

U.S. PATENT DOCUMENTS

| | | | |
|---|---|---|---|
| 2,244,301 | 6/1941 | Le Gore | 134/93 |
| 2,403,526 | 7/1946 | Harris | 134/115 R |
| 2,704,241 | 3/1955 | Gannon | 134/93 X |
| 2,850,025 | 9/1958 | Bond | 134/177 |
| 3,680,567 | 8/1972 | Hansen | 134/115 R X |
| 3,773,060 | 11/1973 | Byrd | 134/179 |
| 3,926,668 | 12/1975 | Ross | 134/100 X |
| 4,420,005 | 12/1983 | Armstrong | 134/100 |

FOREIGN PATENT DOCUMENTS

| | | | |
|---|---|---|---|
| 1018558 | 1/1966 | United Kingdom | 134/115 R |

*Primary Examiner*—Philip R. Coe

*Attorney, Agent, or Firm*—Davis Hoxie Faithfull & Hapgood

[57] ABSTRACT

A dishwashing apparatus for placement over a sink, to facilitate the washing of dishes and the like, includes an enclosure, formed at least in part, of a substantially translucent plastic material. Sealing means are disposed along the lower edges of the side portions of the enclosure for substantially sealing the interior of the enclosure from the exterior thereof, when the lower edges of the side portions are disposed about the perimeter of the sink. A nozzle is connected to the enclosure and disposed on the interior thereof, and means are provided for connecting the nozzle to a faucet on the sink. Means are also provided for supplying a detergent to the interior of the enclosure and means are provided for manually moving the nozzle from the exterior of the enclosure.

17 Claims, 3 Drawing Figures

DISHWASHING APPARATUS

BACKGROUND OF THE INVENTION

The present invention relates to the field of inexpensive, portable kitchen appliances, and in particular, to an inexpensive, portable kitchen appliance for facilitating the washing of dishes.

It is well known that the daily routine of washing dishes is a task not particularly enjoyed by those having to do so. With the advent of automatic dishwashing machines, the drudgery of having to wash dishes, and the concomitant damage to the hands of those who wash dishes, is eliminated. However, automatic dishwashing machines are expensive, require external power sources, and a substantial amount of room.

OBJECTS AND SUMMARY OF THE INVENTION

It is therefore an object of the present invention to overcome the shortcomings associated with prior art dishwashing machines.

It is a further object of the present invention to provide an inexpensive, portable dishwashing apparatus.

Briefly, the present invention is directed to a dishwashing apparatus for placement over a sink to facilitate the washing of dishes and the like. The apparatus includes an enclosure formed, at least in part, of a substantially translucent plastic material, the enclosure having side portions and a top portion. Sealing means are disposed along lower edges of the side portions of the enclosure, for substantially sealing the interior of the enclosure from the exterior thereof, when the lower edges of the side portions are disposed about the perimeter of the sink. A nozzle is connected to the enclosure and disposed on the interior thereof, and means for connecting the nozzle to a faucet on the sink are provided. Also included are means for supplying a detergent to the interior of the enclosure and means for manually moving the nozzle from the exterior of the enclosure.

The side portions and top portion of the enclosure may be substantially planar in shape or alternatively, the top portion of the enclosure may be dome-shaped. The top portion is preferably slidable along grooves formed in at least some of the side portions, to thereby allow access to the interior of the enclosure while the enclosure is in place over the sink. Also provided are means for providing access to hot and cold water knobs on the sink while the enclosure is in place over the sink. Preferably, this takes the form of a plurality of doors slidably mounted on opposing ones of the side portions. Also, handles may be provided for facilitating the placement, removal and transport of the apparatus.

The means for supplying the detergent to the interior of the enclosure may comprise a reservoir for holding a liquid detergent, a first tube connected at one end to the reservoir and at an opposite end to the nozzle, and a pump for forcing the liquid detergent through the first tube. The means for connecting the nozzle to the faucet may include a second tube, releasably connected at one end to the faucet and connected at an opposite end to the nozzle.

BRIEF DESCRIPTION OF THE DRAWINGS

These and other objects and aspects of the invention will be described in more detail with reference to the following drawing figures of which.

DETAILED DESCRIPTION OF THE INVENTION

Figure 1:
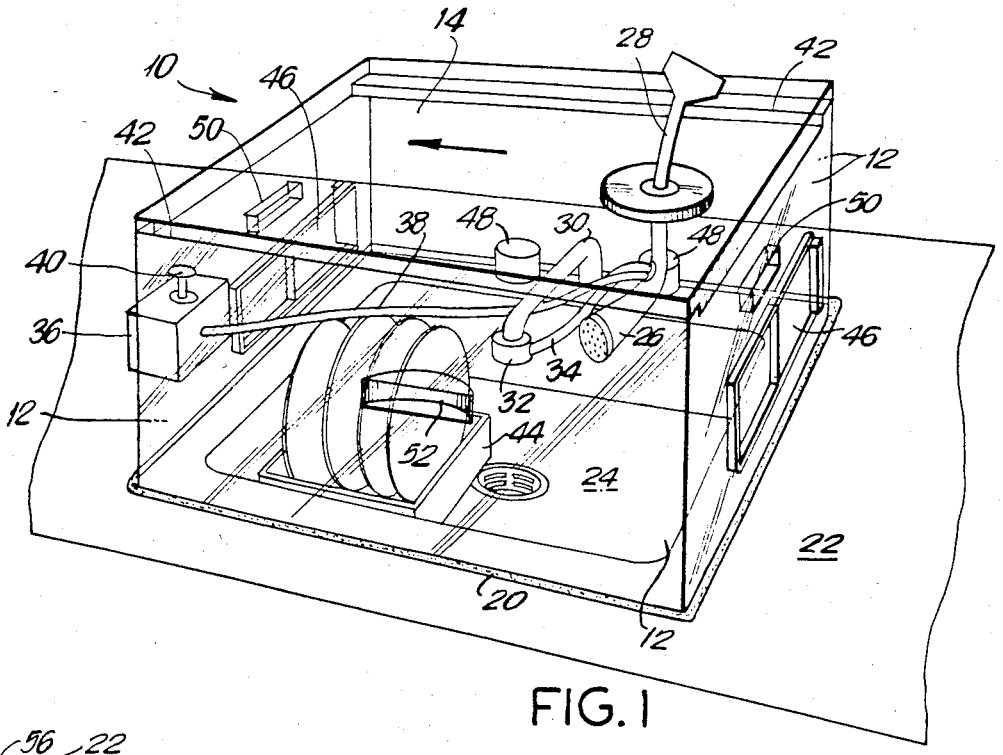
FIG. 1 is a perspective view of the dishwashing apparatus having a planar top portion, in accordance with the present invention.
Figure 2:
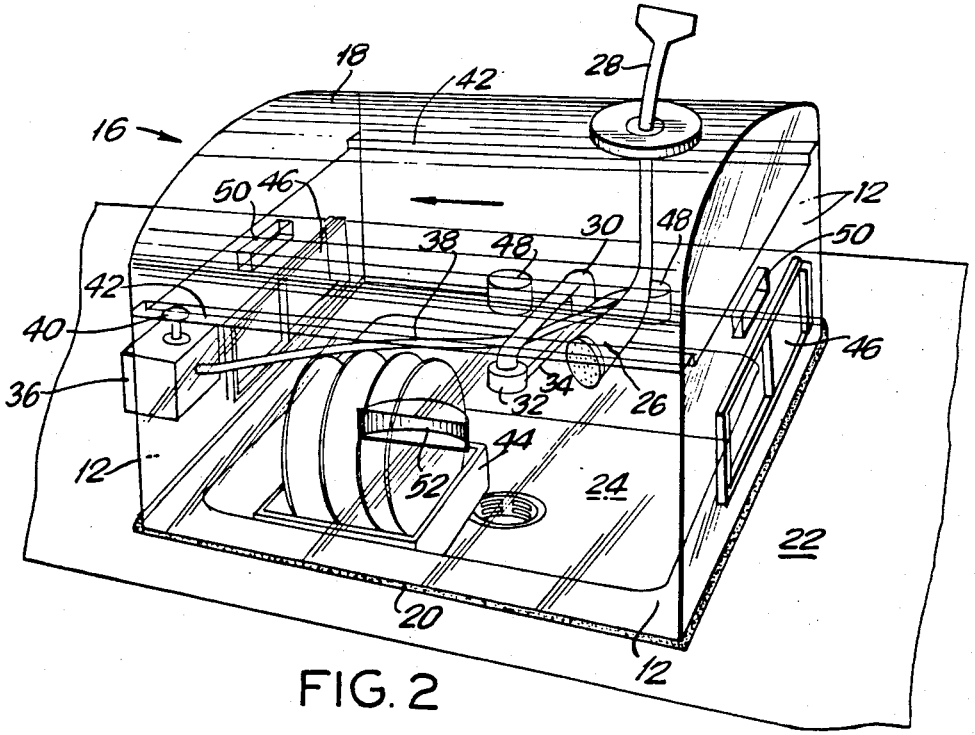
FIG. 2 is a perspective view of an alternative construction of the dishwashing apparatus, having a dome-shaped top portion.

FIGS. 1 and 2 illustrate two alternative embodiments of the present invention and include common elements. Like reference numerals in FIGS. 1 and 2 will be used to denote like elements used in the two embodiments.

With first reference to FIG. 1, an enclosure 10 is formed of a substantially translucent plastic material, such as lucite, or the like, and includes planar side portions 12 and a planar top portion 14. In FIG. 2, an alternative embodiment of the apparatus is shown having an enclosure 16 formed of substantially planar side portions 12 and a dome-shaped top portion 18. Other configurations will become apparent to those skilled in the art, in view of the disclosure herein.

Figure 3:
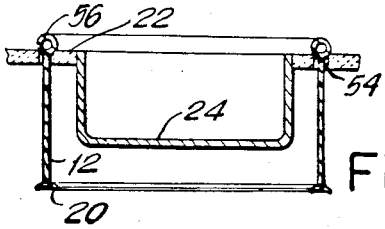
FIG. 3 is a cross-sectional view of the dishwashing apparatus when not in use, in accordance with an optional feature of the present invention.

In both FIGS. 1 and 2, a flexible sealing means 20, preferrably made of a rubber-type material, having an inverted "U" shaped cross-section (as shown in FIG. 3), for example, is disposed along the lower edges of the side portions of the enclosure. The sealing means 20 is adapted to form a substantially water-tight seal between counter top 22 and the side portions 12, such that the interior of the enclosure is substantially sealed from the exterior thereof when the lower edges of the side portions are disposed on the counter top 22, about the perimeter of a sink 24.

A nozzle 26 is connected to the top portion of the enclosure such that it is disposed on the interior thereof. The nozzle is connected to a swivel handle 28, by means of an appropriate mechanical linkage, to facilitate the manual movement of the nozzle 26 within the enclosure, from the exterior thereof.

The nozzle 26 may be connected to a faucet 30 on the sink by means of a releasable connector 32, and a tube 34 connected on one end to the releasable connector 32 and on the other end to the nozzle 26. A liquid detergent may be supplied to the nozzle 26 through the use of a reservoir 36 for holding the detergent, a tube 38 connected at one end to the reservoir and at an another end to the nozzle 26, and a pump 40 for forcing the liquid detergent through the tube 38 and into the nozzle 26.

When the enclosure is in place about the perimeter of the sink 24, access to the interior thereof is provided by sliding the top portion 14 or 18, in the direction indicated by the arrows, along grooves 42 provided in the side portions of the enclosures. Depending upon the vertical extent of the nozzle 26, the sliding movement of the top portion 14 or 18 will be limited by the left-most side 12 (as shown). However, by disposing the nozzle 26 and handle 28 on the top portion 14 or 18 offset to the right, an adequate amount of movement of the top portion is provided, thus allowing ready access to the interior. Alternatively, the top portions 14 or 18 may be hinged on one of the side portions 12 if desired; still other expedients for connecting the top portion to the side portions, while allowing access to the interior, will become apparent to those skilled in the art in view of the present disclosure.

A rack of dishes 44 may be placed in a convenient location in the sink 24 and the top portion 14 or 18 moved back into place as shown in FIGS. 1 and 2. A pair of sliding doors 46 are provided on opposing sides to allow the user access to hot and cold water knobs 48. By use of the sliding doors 46, the user may adjust to the hot and cold water accordingly and then close the doors 46 to proceed in washing the dishes. By means of handle 28, the spray from nozzle 26 is directed to the dishes as desired. Detergent is delivered to the dishes by actuating the pump 40 on the detergent reservoir 36. When the washing of the dishes is complete, the user slides doors 46 open, turns the hot and cold water off and slides the top portions 14 or 18 to the left, to retrieve the dishes. Alternatively, the water flow could be controlled electronically at the releasable connector 32, if desired.

A pair of handles 50 may be molded into opposing side walls 12, in order to facilitate the placement of the enclosures 10 or 16 on counter top 22. An additional handle 52 may be provided to facilitate the transportation of the apparatus, as desired.

An alternative arrangement is shown in FIG. 3, wherein counter top 22 is provided with a cut-out portion 54 along the perimeter of the enclosure, such that the side portions 12 can be recessed underneath the counter top 22 when not in use. When this is desired, the top portion 14 or 18, and reservoir 36 must be releasable from the side portions 12, so that the side portions can be lowered to the point where the top of the side portions 12 is about at the same level as the counter top. Handles 56, which would be provided instead of handles 50, provide a vertical stop for the side walls and facilitate the raising of the side walls into an operative position. When pulled upwardly through the cut-out 54, the flexible seal will be drawn through the cut-out and rest upon the counter-top when in use. After use, the flexible seal 20 can be forced downwardly through the cut out.

The foregoing description is intended to be exemplary rather than limiting. Changes and variations to the present invention will occur to those skilled in the art in view of the foregoing description. For example, an opposing pair of side portions 12 can be provided with a series of vertical slots, and one of the side portions therebetween can be slidably mounted within any one pair of slots, in accordance with the size of the sink, in order to reduce or increase the size of the enclosure to match the sink. It is intended that this and other changes and variations be encompassed so long as the present invention is employed as defined by the following claims.

What I claim is:

1. Apparatus for placement over a sink to facilitate the washing of dishes and the like, comprising:

an enclosure formed, at least in part, of a substantially translucent plastic material, said enclosure having side portions and a top portion;

sealing means disposed along lower edges of said side portions of said enclosure, for substantially sealing the interior of said enclosure from the exterior thereof, when said lower edges of said side portions are disposed about the perimeter of said sink;

a nozzle connected to said enclosure and disposed on the interior thereof;

means for connecting said nozzle to a faucet on said sink;

means for supplying a detergent to the interior of said enclosure; and means for manually moving said nozzle from the exterior of said enclosure.

2. The apparatus of claim 1 wherein said side portions and said top portion of said enclosure are substantially planar.

3. The apparatus of claim 2 wherein said top portion is slidable along grooves formed in at least some of said side portions, to thereby allow access to the interior of said enclosure while said enclosure is in place over said sink.

4. The apparatus of claim 3 further comprising means for providing access to hot and cold water knobs on said sink while said enclosure is in place over said sink.

5. The apparatus of claim 4 wherein said means for providing access comprise a plurality of doors slidably mounted on opposing ones of said side portions.

6. The apparatus of claim 5 further including handle means for facilitating the placement, removal and transport of said apparatus.

7. The apparatus of claim 1 wherein said top portion of said enclosure is dome-shaped.

8. The apparatus of claim 7 wherein said top portion is slidable along grooves formed in at least some of said side portions, to thereby allow access to the interior of said enclosure while said enclosure is in place over said sink.

9. The apparatus of claim 8 further comprising means for providing access to hot and cold water knobs on said sink while said enclosure is in place over said sink.

10. The apparatus of claim 9 wherein said means for providing access comprise a plurality of doors slidably mounted on opposing ones of said side portions.

11. The apparatus of claim 10 further including handle means for facilitating the placement, removal and transport of said apparatus.

12. The apparatus of claim 1 wherein said means for supplying a detergent to the interior of said enclosure comprises a reservoir for holding a liquid detergent, a first tube connected at one end to said reservoir and at an opposite end to said nozzle, and a pump for forcing said liquid detergent through said first tube.

13. The apparatus of claim 12 wherein said means for connecting said nozzle to said faucet comprises a second tube, releasably connected at one end to said faucet, and connected at an opposite end to said nozzle.

14. The apparatus of claim 13 wherein said first and second tubes intersect in the proximity of said nozzle.

15. The apparatus of claim 14 further including handle means for facilitating the placement, removal and transport of said apparatus.

16. The apparatus of claim 12 wherein said top portion and said reservoir are removable from said side portions to facilitate the lowering of said side portions below said sink through a cut-out provided therefor at said perimeter of the sink.

17. The apparatus of claim 1 wherein said top portion is removable from said side portions to facilitate the lowering of said side portions below said sink through a cut-out provided therefor at said perimeter of the sink.

* * * * *